United States Patent [19]

Pillifant, Jr.

[11] Patent Number: 4,845,809

[45] Date of Patent: Jul. 11, 1989

[54] LEAF SPRING BIASED POSITION RETENTIVE HINGE ASSEMBLY

[76] Inventor: Albert Pillifant, Jr., 1406 E. Pine St., Midland, Mich. 48640

[21] Appl. No.: 170,760

[22] Filed: Mar. 21, 1988

[51] Int. Cl.[4] ..... E05D 11/08

[52] U.S. Cl. ..... 16/259; 16/267; 16/341; 16/385; 16/DIG. 13; 296/97.6; 296/97.8

[58] Field of Search ..... 16/252, 257, 259, 267, 16/331, 332, 334, 341, 342, 344, 352, 382, 385, DIG. 13; 296/97 C, 97 F, 97 H, 97 K

[56] References Cited

U.S. PATENT DOCUMENTS

| | | | |
|---|---|---|---|
| 1,535,810 | 4/1925 | Brey | 296/97 C X |
| 2,733,830 | 2/1956 | Ruskin | 16/259 X |
| 3,703,742 | 11/1972 | Konishi | 16/DIG. 29 X |
| 4,309,792 | 1/1982 | Faye | 16/385 X |

FOREIGN PATENT DOCUMENTS

| | | | |
|---|---|---|---|
| 278291 | 10/1927 | United Kingdom | 16/334 |

OTHER PUBLICATIONS

National Manufacturing Company, V130 Super Swing n' Stay ® Hinge Package.

Amerock Corporation, Xerox Immage, Front and Back View, Self Closing Hinge, BP-7928-26.

*Primary Examiner*—Fred A. Silverberg

*Attorney, Agent, or Firm*—Timothy S. Stevens; Edward E. Schilling

[57] ABSTRACT

A position retentive hinge assembly is provided in which two bodies are swing about one or more axially aligned hinge pins. The first body has at least two paired supports holding the one or more hinge pins. The second body has a receiving and retaining portion for each hinge pin. The inner end face of at least one support is non-planar and cooperates with a non-planar opposed adjacent end face of a receiving and retaining portion of the second body. A spring confined between a support and an end face urges the non-planar opposed faces together and position retentive cam and cam follower action is had as the bodies are swung pivotally.

8 Claims, 5 Drawing Sheets

LEAF SPRING BIASED POSITION RETENTIVE HINGE ASSEMBLY

FIELD OF THE INVENTION

The present invention is in the field of hinge assemblies and more specifically in the field of position retentive hinge assemblies.

BACKGROUND OF THE INVENTION

The technology of hinges having elongated hinge pins coextensive with a major portion of adjoining edges of hinged bodies or members is well developed. Generally, one body is joined to another by such a hinge so that one body can be swung relative to the other body about the axis of the elongated hinge pin. Not infrequently, a hinge assembly will have some means of retentively positioning the bodies at one or more angles of swing. For example, automobiles usually have a means to resiliently hold doors in an open position.

The Amerock Corporation of Rockford, Illinois sells a self closing hinge, part number BP-7928-26, that incorporates a spring and rubbing block. The first body of the hinge has two support portions for supporting the single elongated hinge pin near its ends. A rubbing block is attached to the first body between the support portions by means of a springy integrally formed flange portion that is L-shaped in section and extends laterally from the first body to entrap the rubbing block. The second body has a tubular portion adapted to receive and retain the central portion of the hinge pin in the bore of the tubular portion. The exterior of a portion of the tubular portion defines a surface that is disposed radially about and substantially coaxial to the longitudinal axis of the hinge pin. The rubbing block is trapped and somewhat compressed between the tubular surface and the first body. The rubbing block is pressed against the tubular surface by the spring portion so that as the hinge is pivoted throughout most of its range the rubbing block provides frictional resistance.

However, when the hinge is pivoted near its closed position, the rubbing block presses into an inclined portion of a concavity in the tubular surface and moves closer to the longitudinal axis of the hinge pin which forces the hinge into its closed position.

The National Manufacturing Company of Sterling, Illinois sells the Super Swing n' Stay cafe door hinge which incorporates a cam and a cooperating protruding knife-like projection to ride thereon. With this hinge assembly lower and upper brackets are attached to a door frame while top and bottom pivots are attached to the top and bottom of a swinging cafe-type door near a vertical edge thereof. The upper pivot holds an upper hinge pin which is journalled in an upper pivot bearing attached to the upper bracket. The lower pivot holds a lower hinge pin, axially aligned with the upper hinge pin, which is journalled in a lower pivot bearing attached to the lower bracket. The spacing between the upper and lower brackets is such that the door can move up and down about one half an inch as the hinge pins slide up and down about one half an inch in the direction of their common axis, and swing from side to side about the axis of the hinge pins. The bottom bracket has an upward facing sliding surface disposed radially about and substantially normal to the axis of the lower hinge pin, which surface is non-planar and in the shape of a cam. The bottom pivot has a dull knife-like projection that rests on the cam. When the door is swung from its normal position, the knife-like projection rotates and rides up the cam raising the door against the force of gravity. When the door is released, the force of gravity on the door causes the knife-like projection to ride the cam downward and the door returns to its normal position, the low point of the cam being positioned relative to the knife-like projection to coordinate with the door closed position.

Problems with prior position retentive hinge assemblies include the excessive number of parts used and difficulties of incorporating the prior concepts into injection molded hinge assemblies.

SUMMARY OF THE INVENTION

The position retentive hinge assembly of the present invention solves the above-mentioned problems and is of the type comprising a first body, a second body and at least one elongated hinge pin. When more than one hinge pin is used, they all are axially aligned. The first body is molded or otherwise formed to have at least two spaced apart support portions for supporting a hinge pin near its ends. The second body is molded or otherwise formed to have at least one receiving and retaining portion for receiving and retaining a linear portion of the hinge pin or pins. The support portions of the first body extend enough to support the hinge pin or pins sufficiently far from the remainder of the first body to provide clearance for the at least one receiving and retaining portion of the second body to receive and substantially surround a linear portion of the elongated hinge pin associated therewith and to allow for swinging the first body relative to the second body about the longitudinal axis of the hinge pin or pins from a first pivotal position to at least a second pivotal position. The improvement of the present invention comprises forming a first sliding non-planar surface on at least one of the support portions of the first body, the first sliding surface being disposed radially about and substantially normal to the longitudinal axis of the elongated hinge pin or pins and facing towards a second paired support portion. The improvement of the present inventions also comprises a second sliding non-planar surface formed on the receiving and retaining portion of the second body adjacent and facing the first sliding surface and a spring positioned to urge the sliding surfaces together in a direction along the longitudinal axes of the elongated hinge pin or pins. The sliding surfaces are opposed and have a cam and cam follower relationship and the relative length of the receiving and retaining portion and the spacing between the support portions for the associated elongated hinge pin are such that the spring is confined and compressed between an end of the receiving and retaining portion and the adjacent support portion so that the spring compresses or releases when the first body is swung relative to the second body from a first pivotal position to at least a second pivotal position as the facing surfaces being non-planar move closer or farther apart during the pivotal motion.

DETAILED DESCRIPTION OF THE INVENTION

Figure 1:
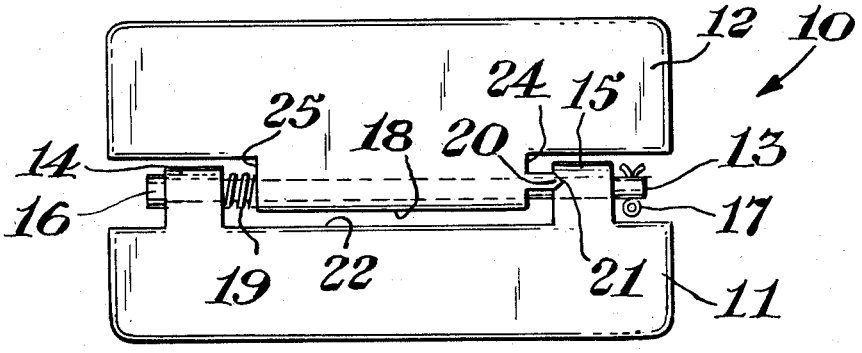
FIG. 1 is a front view of one embodiment according to the invention showing a first body hinged to a second body and a coil spring around an end of the hinge pin urging a projection on the remote end face of the receiving and retaining portion of the second body into a depression in an adjacent end face of one of the supports of the first body near the other end of the hinge pin.

Referring now to FIG. 1, therein is shown a hinge assembly 10 having a first body 11, a second body 12 and an elongated hinge pin 13, the hinge assembly 10 being in an open position. The first body 11 has a pair of support portions 14 and 15 extending from an edge 22 thereof. The support portions 14 and 15 are transversely bored to receive and support the hinge pin 13 near its ends, which extend beyond the support portions. The hinge pin 13 has an enlarged head 16 at one end and a cotter pin 17 extending through a small transverse borehole at the other end to keep the hinge pin 13 in the bores of the support portions 14 and 15. The second body 12 has an elongated longitudinally bored hinge pin receiving and retaining portion 18 for receiving and retaining a linear portion of the hinge pin 13 in the bore thereof. A coil spring 19 surrounding a portion of the hinge pin 13 in a space between an end of the receiving and retaining portion 18 and the adjacent support portion 14, presses against the support portion 14 and one end 23 of the receiving and retaining portion 18. The end face of the other end 24 of the receiving and retaining portion 18 is shown having a projection 20 extending axially of the longitudinal axis of the hinge pin 13 into a notch 21 formed in the opposed interior surface of the support portion 15. Thus, the spring 19 urges the projection 20 into the notch 21. When the body 12 is swung about the longitudinal axis of the hinge pin 13 from the position shown, the projection 20 rides out of the notch 21 and the second body 12 is axially displaced relative to the first body 11 along the longitudinal axis of the hinge pin 13 toward the support portion 14, compressing the spring 19. The notch 21 and the projection 20 comprise sliding surfaces that are non-planar and have complementary angularly disposed undulations or bosses whereby the surfaces are axially displaced at one pivotal position relative to another. The notch 21 and the projection 20 thus have a cam and cam follower relationship. One desired characteristic of the embodiment shown in FIG. 1 is that the projection 20 always is in rubbing contact with a portion of the interior end face of the support portion 15, being urged thereagainst whatever the pivotal position of the assembly 10 so that there is always frictional resistance to pivoting the assembly; and when the assembly nears the open position shown in FIG. 1, the projection 20 is urged by the spring 19 into the notch 21 to positively position and resiliently retain the assembly. If desired, the resiliently retained position can be provided in any other relative angular relationship of the bodies by changing the angular disposition of the notch 21.

Figure 2:
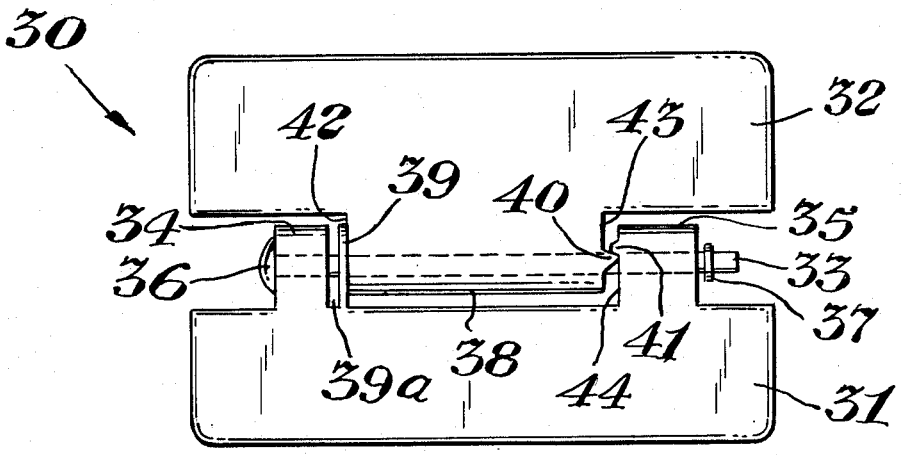
FIG. 2 is a front view of another embodiment according to the invention showing a first body hinged to a second body and a spring in the form of a leaf integrally formed with one of the supports of the first body for urging a projection on an end face of the receiving and retaining portion of the second body toward the interior end face of the other support portion of the first body, the interior end face having thereon a boss or projection that cooperates with the projection of the opposing face to give cam action.

Referring now to FIG. 2, therein is shown another hinge assembly 30 having a first body 31, a second body 32 and an elongated hinge pin 33, the assembly 30 being in an open position. The first body 31 has transversely bored hinge pin support portions 34 and 35 for supporting the hinge pin 33 near its end in the bores of the support portions 34 and 35. The hinge pin 33 has an enlarged head 36 at one end and a snap-ring 37 at the other end to keep the hinge pin 33 in the bores of the support portions 34 and 35. The second body 32 has an elongated longitudinally bored hinge pin receiving and retaining portion 38 for receiving and retaining a linear portion of the hinge pin 33 in the bore thereof. A leg-like leaf spring 39 has been formed of the interior edge or face of the support portion 34 as by making a saw cut in or molding the support portion so as to form a slot or recess **39*a* extending entirely through the support portion from face to face of the body 31, leaving a relatively thin springy leg with a free end. The leg-like leaf spring 39 presses against one end 42 of the hinge pin receiving and retaining portion 38. The end face 43 of the other end of the receiving and retaining portion 38 is shown having a projection 40 extending axially of the longitudinal axis of the hinge pin 33 onto the opposed interior face 44 of the support portion 35. A boss 41 is shown extending axially of the longitudinal axis of the hinge pin 33 toward the receiving and retaining portion 38 and radially toward but not quite to the hinge pin 33. When the body 31 is pivoted back of the plane of the drawing as here shown in the projection 40 rides up the boss 41 and the second body 32 is axially displaced relative to the first body 31 along the longitudinal axis of the hinge pin 33 toward the support portion 34, compressing the leaf spring 39. The projection 40 and the boss 41 thus have a cam and cam follower relationship. If desired, additional bosses can be formed on the opposed face of the support portion 35 to provide additional retentive positions of pivotal rotation of the bodies of the assembly 30**.

Figure 3:
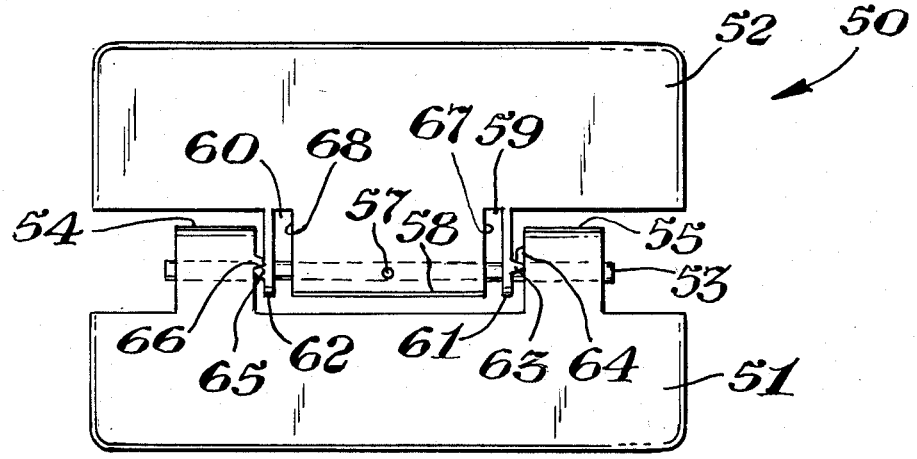
FIG. 3 is a front view of another embodiment according to the invention showing a first body hinged to a second body with the receiving and retaining portion of the second body having two integral leaf springs and projections on each end face so that the projections are each respectively urged into contact with an opposed surface or interior face of one of the support portions of the first body, such opposed surfaces each having a projection or boss, the projections giving a cam action as the surfaces are rotated during pivotal motion of the bodies.

Referring now to FIG. 3, therein is shown another hinge assembly 50 having a first body 51, a second body 52 and an elongated hinge pin 53, the assembly 50 being in an open position. The first body 51 has transversely bored hinge pin support portions 54 and 55 for supporting the hinge pin 53 near its end in the bores of the support portions 54 and 55. The second body 52 has an elongated longitudinally bored receiving and retaining portion 58 for receiving and retaining a linear portion of the hinge pin 53 in the bore thereof. A pin 57 that extends transversely through a smaller bore hole that intercepts the longitudinal borehole in the receiving and retaining portion 58 as well as the hinge pin 53 about midway the length thereof is used keep the hinge pin 53 in the bore of the receiving and retaining portion 58. Two leg-like leaf springs 61 and 62 have been formed, at the longitudinal ends 67 and 68 of the receiving and retaining portions 58 of the second body 52, as by making a saw cut in or molding the receiving and retaining portion so as to form a slot or recess 59 and 60 at the said ends 67 and 68. The slot or recess extends entirely through the receiving and retaining portion 58 from face to face thereof leaving a relatively thin springy leg 61 and 62 with a free end, the legs also having a transverse borehole therethrough through which the hinge pin 53 extends. The spring 61 has a lateral facial projection 63 extending axially of the longitudinal axis of the hinge pin 53 toward and contacting the opposed non-planar interior face of the support portion 55. A boss 64 on said interior face is shown extending axially of the longitudinal axis of the hinge pin 53 toward the leaf spring 61 of the receiving and retaining portion 58 and disposed radially toward but not quite to the hinge pin 53. The leaf spring 62 similarly has a lateral facial projection 65 extending axially of the longitudinal axis of the hinge pin 53 toward and contacting the opposed non-planar interior face of the support portion 54. A boss 66 on said interior face is shown extending axially of the longitudinal axis of the hinge pin 53 toward the leaf spring 62 of the receiving and retaining portion 58 and disposed radially toward but now quite to the hinge pin 53. When the body 51 is swung by pivoting it back of the plane of the drawing as here shown, the projections 63 and 65 ride up the bosses 64 and 66 and the second body 52 substantially is not axially displaced relative to the first body 51 along the longitudinal axis of the hinge pin 53 toward or away from the support portion 55 but the leaf springs 61 and 62 are compressed. The projections 63 and 65 on the leaf springs and their respective associated bosses 64 and 66 on the non-planar faces of the support portions 55 and 54 thus have a cam and cam follower relationship. If desired, the face of each of the support portions 55 and 54 having respective bosses 64 and 66 can be formed with one or more additional undulations or bosses to provide for additional retentive positions of swing of the assembly 50. Alternatively, the face of each of the springs 61 and 62 having respective projections 63 and 65 can be formed with one or more additional undulations or bosses to provide for additional retentive positions.

Figure 4:
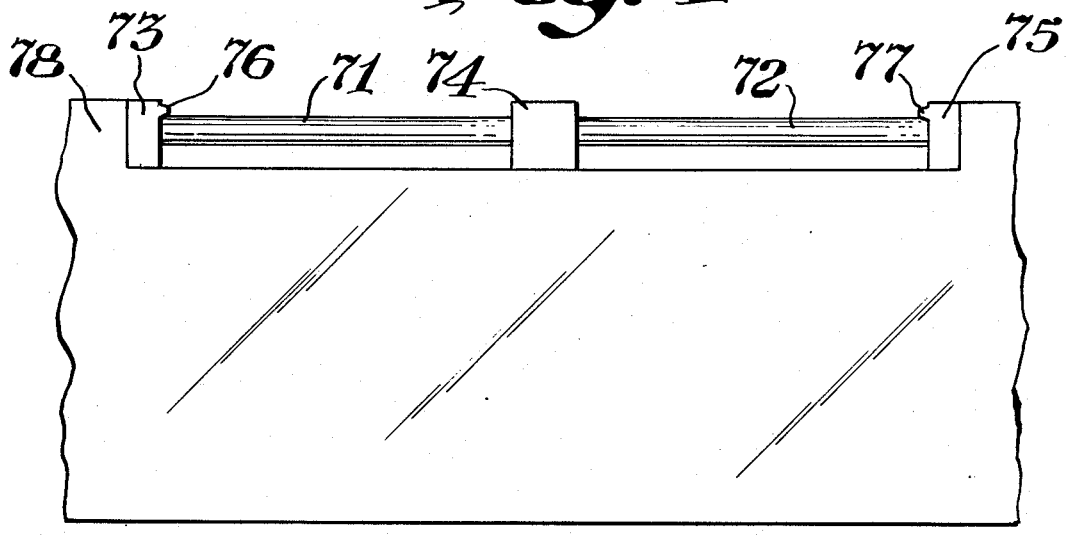
FIG. 4 is a fragmentary front view of a first body according to the invention in the form of a molded plastic see-through light filtering panel having a pair of hinge pins integrally molded with support portions projecting from the surface of the panel.
Figure 5:
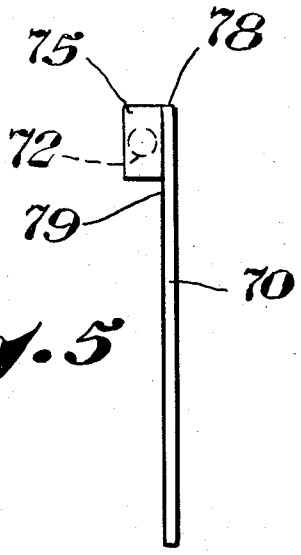
FIG. 5 is an end view of the first body shown in FIG. 4.

Referring now to FIGS. 4 and 5, a preferred first body according to the invention is seen to have the form of a panel 70 which may be molded of a see-through, light absorbing systhetic molding polymer, preferably a dyed polycarbonate type thermoplastic molding polymer. The panel 70 has two axially aligned hinge pins 71 and 72 which are integrally formed at each end of each hinge pin with spaced apart supporting portions 73, 74 and 75 extending from a face 79 of the panel 70 adjacent the edge 78 and of the same systhetic molding polymer as the panel 70, preferably by the injection molding process. Support portion 74, about midway between support portions 73 and 75, is paired therewith, in turn, to support respectively, hinge pins 71 and 72. In order that clearance may be provided for receiving and retaining portions of the other body of the assembly to be pivotally swung around the hinge pins 71 and 72, the longitudinal edge 78 of the panel 70 is recessed between the further apart support portions 73 and 75. Providing such recess is an alternative to providing the structure with no recess as in FIGS. 1, 2 and 3.

Figure 6:
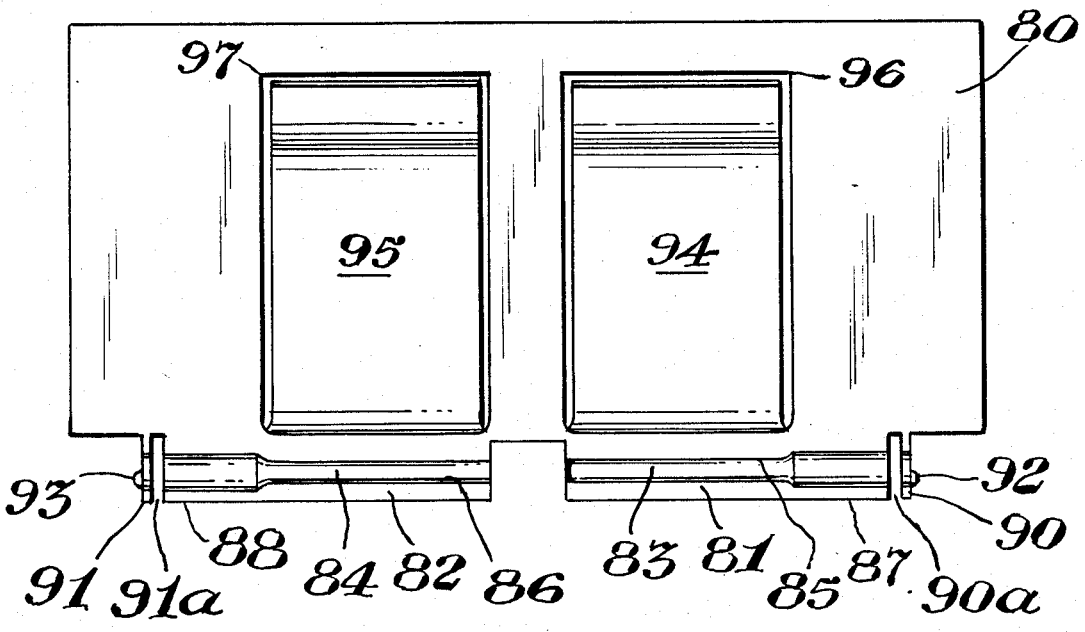
FIG. 6 is a front view of a second body according to the invention incorporating clamps adapted to be slid onto an automotive sun-visor and also showing slotted clip portions adapted to laterally receive and resiliently but pivotably retain linear portions of each hinge pin of the panel shown in FIG. 4.
Figure 8:
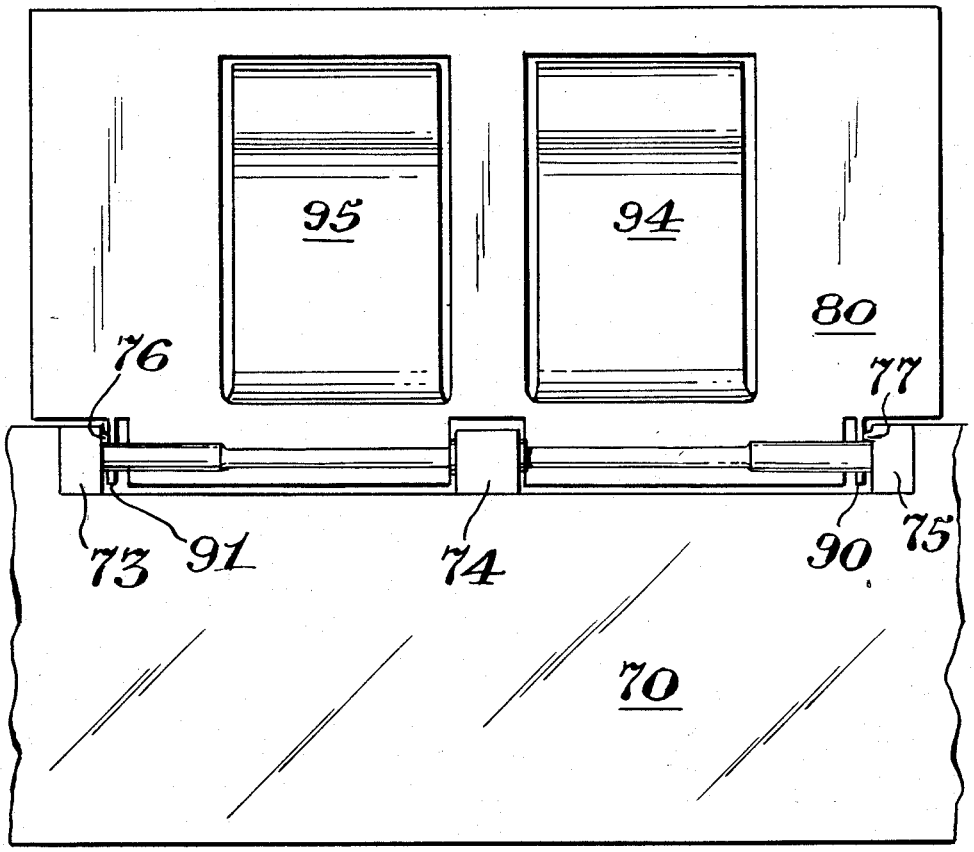
FIG. 8 is a front view of an assembly of the bodies shown in FIGS. 4 and 6 with the plane of the second body 180 degrees from the plane of the first body.

It will also be noted upon reference to FIG. 4 that the lateral face of support portion 73 facing towards paired support portion 74 is not planar, but is formed with a projection 76 adjacent the hinge pin 71. The function of projection 76 will be better understood with reference to FIG. 6, showing the body with which it is hinged, FIG. 8, showing the assembly of the two bodies, and the enlarged fragmentary view in FIG. 9. Likewise, the lateral face of support portion 75 facing towards the paired support portion 74 is not planar but is formed with a projection 77 adjacent the hinge pin 72 and serves a similar function as a cam or cam follower.

It should be understood that the pins 71 and 72 do not have to be round in cross-section and preferably are slightly flatted at the mold-parting line and that a first body according to the invention can be molded of any suitable molding polymer including fiber reinforced molding polymers. Referring to FIG. 5, it is seen that the support portions, of which only support portion 75 is visible, are formed on one face 79 immediatly adjacent the edge 78 of the panel.

Figure 7:
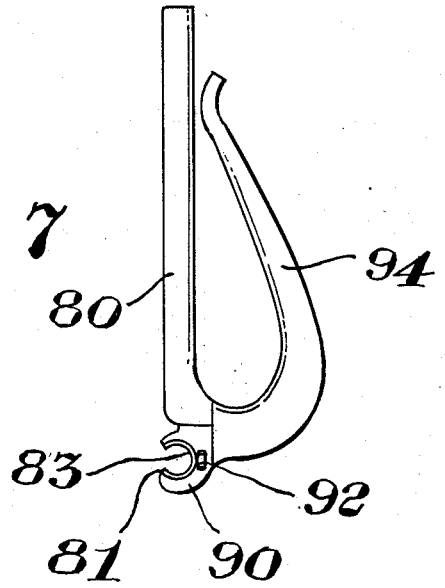
FIG. 7 is an end view of the second body shown in FIG. 6.

Illustrated in FIGS. 6 and 7 is a second body 80, formed, preferably by the injection molding process, of a synthetic molding polymer. One suitable polymer is pigmented acrylonitrile-butadiene-styrene type thermoplastic molding polymer. The body 80 has two receiving and retaining portions in the form of slotted clip portions 81 and 82, each adapted to laterally receive and resiliently but pivotably retain a linear portion respectively of the pins 72 and 71 of the body 70 shown in FIG. 4, the pins 72 and 71 being pivotal within channels 83 and 84 in the respective clip portions 81 and 82. The diameters of the channels 83 and 84 are slightly smaller than the diameter of the respective pins 72 and 71, and the slot openings 85 and 86 are only slightly to somewhat smaller than the diameter of the pins 72 and 71 so that the pins 72 and 71 can be pressed through the slot openings 85 and 86 into the channels 83 and 84 and be resiliently but pivotably retained in the channels and offer some frictional resistance to pivoting about the axis of the pins 72 and 71. The channels 83 and 84 and especially the leg-like leaf springs 90 and 91 are shown counterbored at each outward end to prevent contact between the pin 71 and 72 and the counterbored portion of the channels 83 and 84 and especially the leg-like leaf springs 90 and 91 so that the springs are free to flex. Similarly, in any case as in the apparatus shown in FIGS. 2 and 3 where the leg-like leaf spring is used, there must be sufficient clearance between the spring and the hinge pin so that the spring is free to flex. The pair of leg-like leaf springs 90 and 91 are integrally molded or otherwise formed of and at the outward end faces of the slotted clip portions 81 and 82 of the body 80. The leg-like leaf springs 90 and 91 each are substantially coextensive transversely with the transverse dimensions of the ends of the spring clip portions and the leaf springs each have one end attached to the second body 80 and a free end extending substantially to an edge 87–88 of the spring clip portions, with a recess or slot 90*a* and 91*a* extending entirely transversely through the spring clip portions 81 and 82 separating the leaf springs 90 and 91 from the adjacent ends of the spring clip portions 81 and 82. The leg-like leaf springs 90 and 91 then constitute the end faces of the receiving and retaining portions here identified as spring clip portions 81 and 82. These end faces are non-planar, having a boss or cam-like projection thereon. If desired, leaf springs may be used which are not co-extensive with the spring clip portion but merely extend along and beside the hinge pin. The leaf spring 90 has a projection 92. The leaf spring 91 has a projection 93.

The second body 80 may be shaped in various ways, as may be desired, or provided with special features to adapt the body to a particular use, as well understood in the art. In a particularly useful form, the body 80 is also provided with two spring-clamping portions 94 and 95 integrally formed therewith. As seen in FIG. 6, the spring-clamping portions 94 and 95 are visable through respective die clearance aperatures 96 and 97 in the frame-like body 80. These clamping portions may be used to mount the body 80 on a conventional opaque automotive sun-visor.

Referring now to FIG. 8, the first body of FIGS. 4 and 5 is shown assembled with the second body of FIGS. 6 and 7 in the position normally used when the assembly is mounted on a conventional automotive sun-visor by means of the spring clamping portions.

Figure 9:
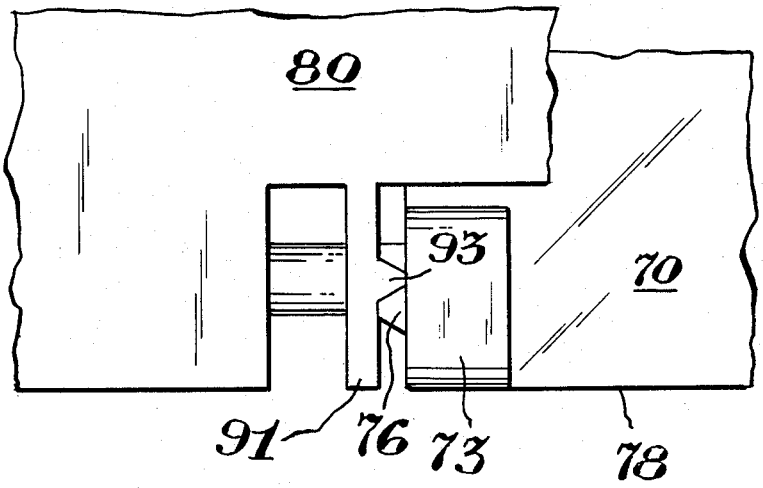
FIG. 9 is an enlarged fragmentary back view of a portion of the assembly of FIG. 8 but with the second body rotated to be nearly co-planar with and adjacent the plane of the first body showing a detailed view of one of the integral leaf springs, one of the projections on the interior face of one of the support portions of the first body and an adjacent projection of an opposing face of the leaf spring portion of the receiving and retaining portion of the second body.

In FIG. 9, there is shown an enlarged fragmentary view of the right side of the back of a portion of the assembly of FIG. 8 as it appears when the panel 70 is pivoted forward of the plane of the drawing of FIG. 8 until the bodies 70 and 80 are folded together nearly face to face. The hinge assembly as shown in FIG. 9 is retained in position by the spring 91 urging the projection 93 against the opposed face of the support 73 and adjacent the boss 76 on the support 73. When the panel 70 is pulled back down pivotally into the position shown in FIG. 8, the boss 76 rides up the projection 93 compressing the spring 91 and then the boss 76 rotates past the projection 93 relieving the spring 91. When the panel 70 is pushed back into the position shown in FIG. 9, so that boss 76 has gone past projection 93 the hinge assembly resiliently retains its position.

What is claimed is:

1. In a position retentive hinge assembly comprising a first body, a second body and at least one elongated hinge pin, provided wherein there is more than one elongated hinge pin the said pins are axially aligned, each hinge pin being supported near its end by at least two support portions forming a part of the first body, the second body having at least one receiving and retaining portion for receiving and retaining a linear portion of each hinge pin, the support portions holding the at least one elongated hinge pin being sufficiently far from the remainder of the first body to provide clearance for the at least one receiving and retaining portion to receive and substantially surround a linear portion of the elongated hinge pin associated therewith and to allow for pivotal movement thereabout said hinge pin, wherein the improvement comprises: a first sliding surface formed on at least one of the support portions of the first body, the first sliding surface being disposed radially about and substantially normal to the longitudinal axis of the at least one elongated hinge pin and facing towards a second paired support portion, a second sliding surface formed on an end of the receiving and retaining portion of the second body adjacent and opposed to the first sliding surface and a spring positioned to urge the sliding surfaces together in a direction along the longitudinal axis of the at least one elongated hinge pin, the sliding surfaces being non-planar, having a cam and cam follower relationship and the relative length of the receiving and retaining portion and the spacing between the support portions for the associated elongated hinge pin being such that the spring is confined and compressed between an end of the receiving and retaining portion and the adjacent support portion so that the spring compresses or releases when the first body is swung relative to the second body from a first pivotal position to at least a second pivotal position within a substantial pivotal movement, and the first body substantially not being axially displaced relative to the second body along the longitudinal axis of the at least one hinge pin when the first body is swung relative to the second body from a first pivotal position to any other pivotal position during axial cam and cam follower action between opposing sliding surfaces.

2. The hinge assembly of claim 1 wherein the spring is a leaf spring integrally formed with one of the support portions of the first body, the leaf spring being an end face of said one of the support portions bearing against an adjacent end face of a receiving and retaining portion of the second body.

3. The hinge assembly of claim 1 wherein at least one spring is a leaf spring integrally formed with the at least one receiving and retaining portion of the second body, each said leaf spring being an end face of said at least one receiving and retaining portion bearing against an end face of an adjacent support portion of the first body.

4. The hinge assembly of claim 3 wherein the first body comprises a see-through light filtering panel and has three hinge pin support portions for supporting two hinge pins, the second body comprises a bracket for clamping the second body to an automotive sun-visor and has two slotted clip portions each adapted to laterally receive and retain a linear portion of each said hinge pin.

5. The hinge assembly of claim 4 wherein the first body is molded of a thermoplastic molding polymer.

6. The hinge assembly of claim 4 wherein the second body is molded of a thermoplastic molding polymer.

7. The hinge assembly of claim 6 wherein each at least one hinge pin is integrally molded with the respective support portions of the first body and the first body and the at least one hinge pin are formed of a polycarbonate type thermoplastic molding polymer.

8. The hinge assembly of claim 7 wherein the second body is molded of an acrylonitrile-butadiene-styrene type thermoplastic molding polymer.

* * * * *